US005916001A

United States Patent [19]

Chadbourne

[11] Patent Number: 5,916,001

[45] Date of Patent: Jun. 29, 1999

[54] INSULATION PIERCING WEDGE CONNECTOR WITH PIERCING SUPPORT WEDGE

[75] Inventor: Richard Chadbourne, Merrimack, N.H.

[73] Assignee: Framatome Connectors USA, Inc., Fairfield, Conn.

[21] Appl. No.: 08/990,312

[22] Filed: Dec. 15, 1997

[51] Int. Cl.[6] ..... H01R 4/02

[52] U.S. Cl. ..... 439/783

[58] Field of Search ..... 439/783, 863, 439/411, 412

[56] References Cited

U.S. PATENT DOCUMENTS

| | | | |
|---|---|---|---|
| 2,106,724 | 2/1938 | Cope | 173/273 |
| 2,814,025 | 11/1957 | Wade et al. | 39/256 |
| 2,828,147 | 3/1958 | Peiffer | 285/138 |
| 3,065,449 | 11/1962 | Matthysse et al. | 439/383 |
| 3,275,974 | 9/1966 | Mixon, Jr. | 439/783 |
| 3,329,928 | 7/1967 | Broske | 439/783 |
| 3,349,167 | 10/1967 | Mixon, Jr. et al. | 174/94 |
| 3,462,543 | 8/1969 | Wahl et al. | 174/94 |
| 3,504,332 | 3/1970 | Mixon, Jr. | 439/796 |
| 3,516,050 | 6/1970 | Mixon, Jr. et al. | 439/783 |
| 3,588,791 | 6/1971 | Polldori | 439/783 |
| 3,811,105 | 5/1974 | Gerhard | 339/98 |
| 3,920,310 | 11/1975 | Walsh et al. | 439/730 |
| 4,059,333 | 11/1977 | Mixon, Jr. | 439/783 |
| 4,070,082 | 1/1978 | Werner | 439/417 |
| 4,533,205 | 8/1985 | Frank | 439/783 |
| 4,600,264 | 7/1986 | Counsel | 439/783 |
| 4,634,205 | 1/1987 | Gemra | 439/391 |
| 4,650,273 | 3/1987 | Roosdrop | 439/783 |
| 4,723,920 | 2/1988 | Werner | 439/782 |
| 4,730,087 | 3/1988 | Werner | 174/94 S |
| 4,734,062 | 3/1988 | Goto | 439/783 |
| 4,813,894 | 3/1989 | Mixon, Jr. | 439/783 |
| 4,863,403 | 9/1989 | Shannon | 439/783 |
| 4,872,856 | 10/1989 | Pooley et al. | 439/783 |
| 4,915,653 | 4/1990 | Mair | 439/781 |
| 5,006,081 | 4/1991 | Counsel et al. | 439/783 |
| 5,044,996 | 9/1991 | Goto | 439/783 |
| 5,145,420 | 9/1992 | Counsel et al. | 439/783 |
| 5,244,422 | 9/1993 | Laricchia | 439/783 |
| 5,507,671 | 4/1996 | Chadbourne et al. | 439/783 |
| 5,538,447 | 7/1996 | Chadbourne et al. | 439/783 |
| 5,558,546 | 9/1996 | Chadbourne et al. | 439/783 |
| 5,613,883 | 3/1997 | Chadbourne et al. | 439/783 |
| 5,679,031 | 10/1997 | Chadbourne et al. | 439/783 |
| 5,842,893 | 12/1998 | De Keyser | 439/783 |

FOREIGN PATENT DOCUMENTS

| | | |
|---|---|---|
| 2070302 | 12/1992 | Canada . |
| 0 653 802 A1 | 5/1995 | European Pat. Off. . |
| 0 810 688 | 12/1997 | European Pat. Off. . |
| 0810687 | 12/1997 | European Pat. Off. . |
| 0810688 | 12/1997 | European Pat. Off. . |
| 3824741 A1 | 1/1990 | Germany . |
| 2 065 994 | 7/1981 | United Kingdom . |

*Primary Examiner*—Neil Abrams
*Assistant Examiner*—T C Patel
*Attorney, Agent, or Firm*—Perman & Green, LLP

[57] ABSTRACT

A wedge connector with a shell and a wedge. The shell has insulation piercing sections to pierce through insulation of electrical conductor cables. The wedge has a frame and piercing supports movably attached to the frame. The piercing supports pierce through insulation of the cables such that conductors in the cables are directly contacted by both the shell and the wedge.

18 Claims, 4 Drawing Sheets

INSULATION PIERCING WEDGE CONNECTOR WITH PIERCING SUPPORT WEDGE

BACKGROUND OF THE INVENTION

1. Field of the Invention

The present invention relates to electrical connectors and, more particularly, to a wedge connector.

2. Prior Art

U.S. Pat. No. 4,600,264 discloses an electric tap connector with a wedge that is moved into the shell by a bolt. U.S. Pat. No. 3,811,105 discloses a shell and a wedge with biting and holding teeth.

SUMMARY OF THE INVENTION

In accordance with one embodiment of the present invention, an electrical wedge connector is provided comprising a shell and a wedge. The shell has a first insulation piercing section adapted to pierce through insulation of an electrical cable and make electrical contact with an electrical conductor section of the cable. The wedge is sized and shaped to be inserted into the shell to sandwich the cable between the wedge and the shell. The wedge has a second insulation piercing section to pierce through the insulation of the cable to directly contact the electrical conductor section of the cable. The electrical conductor section is directly contacted by both the shell and the wedge.

In accordance with another embodiment of the present invention, a wedge for an electrical wedge connector is provided. The wedge comprises a frame with multiple contact surfaces for compressing electrical conductor cables against a wedge connector shell. The improvement comprises the wedge having conductor supports movably mounted to the frame that pierce through insulation of the cables to directly contact electrical conductors of the cables inside the insulation.

In accordance with one method of the present invention, a method of manufacturing a wedge for an electrical wedge connector is provided comprising steps of providing a frame having a general wedge shape; and movably attaching insulation piercing conductor supports on the frame wherein the supports are movable to extend tips of the supports laterally outward from conductor cable contact surfaces of the frame.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
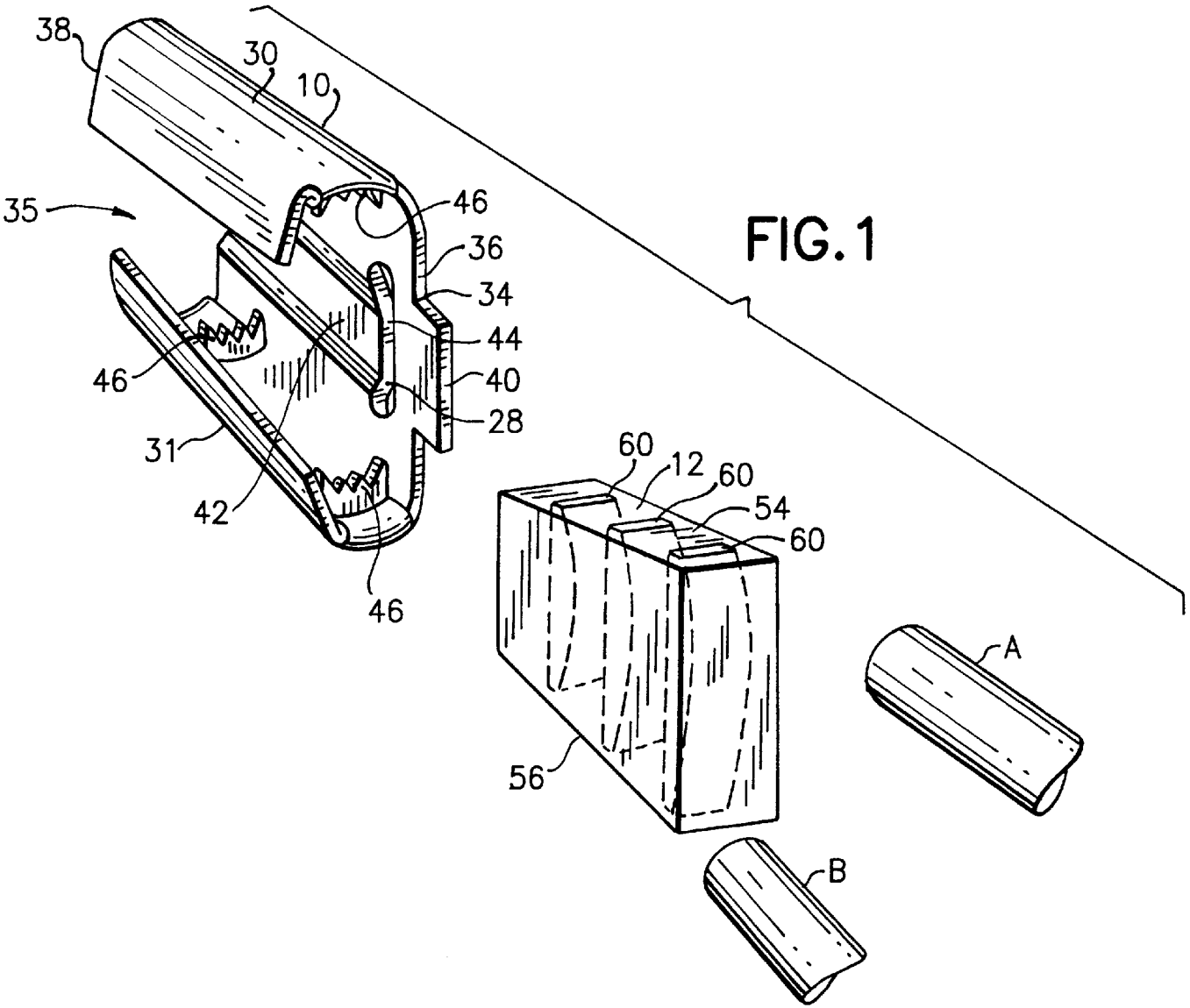
FIG. 1 is an exploded perspective view of an electrical wedge connector incorporating features of the present invention and two electrical conductor cables.

Referring to FIG. 1, there is shown an exploded perspective view of an electrical wedge connector incorporating features of the present invention and two electrical cables A, B. Although the present invention will be described with reference to the embodiments shown in the drawings, it should be understood that the present invention can be embodied in various different forms of embodiments. In addition, any suitable size, shape, or type of elements or materials could be used.

The wedge connector comprises a shell 10 and a wedge 12. The shell 10 is a one-piece member that is preferably made of sheet metal, but it could also be a cast, drawn, or extruded member. The shell 10 has two opposing channel sections 30, 31 interconnected by a middle section 34 to form a general "C" shape with a receiving area 35 for receiving the wedge 12 and the cables A, B. The "C" shape tapers from the rear end 36 to the front end 38. The middle section 34 includes a rear end tab 40, a groove or depression 42, and the slot 28. The slot 28 is located proximate the rear end of the shell and forms a stop ledge 44. The slot 28 extends entirely through the middle section 34 from the interior surface to the exterior surface. However, in an alternate embodiment that slot 28 need not extend entirely through the middle section 34.

The depression 42 extends from the slot 28 to the front end 38 of the shell 10. In another alternate embodiment, the depression 42 need not be provided or need not extend to the front end 38, but if provided the slot 28 should be located at the rear end of the depression 42. The shell 10 includes four conductor piercing sections 46. Two of the piercing sections 46 are provided at the first channel section 30 proximate the front and rear ends 38, 36 of the shell and two of the piercing sections 46 are provided at the second channel section 32 proximate the front and rear ends 38, 36 of the shell. In alternate embodiments more or less than four piercing sections could be provided and they need not be provided proximate the front and rear ends of the shell. The piercing sections could also extend from the middle section 34. In alternate embodiments, any other type of suitable wedge connector shell could be provided.

Figure 2A:
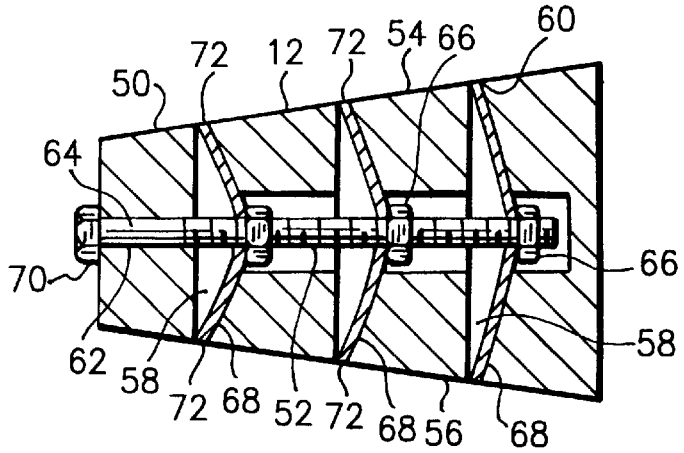
FIG. 2A is a cross-sectional view of the wedge shown in FIG. 1 in its relaxed position.

Referring also to FIG. 2A, a cross-sectional view of the wedge 12 is shown. The wedge 12 generally comprises a frame 50 and an insulation piercing section 52 which forms conductor supports. The frame 50 is preferably a one-piece metal member with two cable contact surfaces 54, 56. The frame 50 also includes pockets 58 with slots 60 at the cable contact surfaces 54, 56 and hole 62 along its center axis into the pockets 58. The insulation piercing section 52 comprises a bolt 64, three nuts 66, and three locking spring leaves 68. The bolt 64 is located in the hole 62 and has its head 70 at a front end of the wedge. The leaves 68 are preferably comprised of spring steel, but could be comprised of other material.

The three leaves have different lengths and are located in the three pockets 58. In alternate embodiments more or less than three leaves and pockets could be provided. Each pocket 58 has a bow-shaped rear wall. Each leaf 68 has a mutual bowed shape as shown in FIG. 2A. Each leaf 68 has a hole through its middle which the bolt 64 passes through. The nuts 66 are separately located on the bolt 64 behind each of the leaves. Tips 72 of opposite ends of each leaf 68 are located at the slots 60; slightly recessed from the cable contact surfaces 54, 56. FIG. 2A shows the wedge 12 with its insulation piercing section in a relaxed or pre-installed state.

Figure 2B:
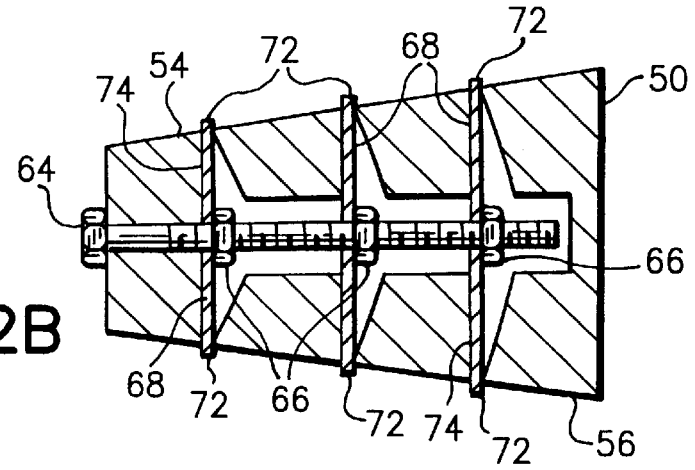
FIG. 2B is a cross-sectional view of the wedge shown in FIG. 2A in its deployed position.

Referring also to FIG. 2B, the wedge 12 is shown with its insulation piercing section in its deployed state. To move from the relaxed state to the deployed state, a user axially rotates the bolt 64. This causes the nuts 66 to move forward along the bolt 64. This moves the middle of the leaves 68 to move forward causing the tips 72 to extend out of the slots 60 laterally outward past the cable contact surfaces 54, 56 of the frame 50. The movement is stopped when the middle of the leaves 68 contact the front walls 74 of the pockets 58.

Figure 3:
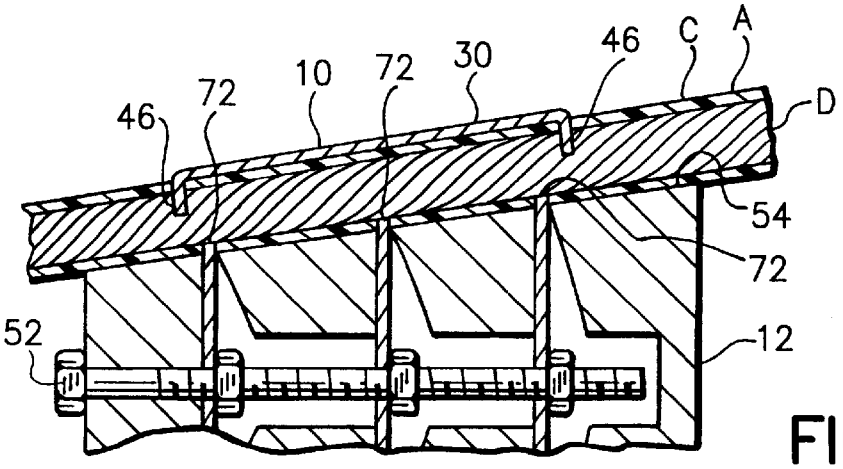
FIG. 3 is a partial cross-sectional view of the wedge connector and cable assembly shown in FIG. 1 in an assembled state.

Referring also to FIG. 3, a partial cross-sectional view of connector attached to the cable A is shown. When the wedge 12 is inserted into the receiving area 35 of the shell 10, the cable A is sandwiched between the cable contact surface 54 and the inner side of the curved channel section 30. The conductor piercing sections 46 pierce through the insulation C and make direct electrical contact with the conductor strands D of the cable A. The user then moves the insulation piercing section 52 from its relaxed state to its deployed state. As the tips 72 move out of the slots 60, they extend into and pierce through the insulation C of the cable A. The length of extension is preferably only enough such that the tips 72 make direct contact with the conductor strands D. However, further depth penetration could be provided.

In the prior art, when insulated conductor cables were attempted to be connected by a wedge connector, a problem developed because of insulation creep. The compression forces in the wedge connector caused the plastic insulation to creep over time. This effects the mechanical integrity of the connection and, thus, also the electrical integrity of the connection. The purpose of the present invention is for the wedge 12 to directly support the conductor section D of the cable against the current carrying teeth of sections 46. This eliminates, or at least reduces, the detrimental effects of insulation creep.

The leaves in the wedge may be made from steel because their primary purpose would not be to carry current. It would be to reduce or eliminate the effects of creep, especially as the connector heats up under an electrical load. They could be used to carry current if required in more electrically demanding applications. In alternate embodiments, other types of insulation piercing sections could be proved on the frame of the wedge including a different type of leaf movement mechanism, and insulation piercers other than the locking spring supports described above.

Figure 4A:
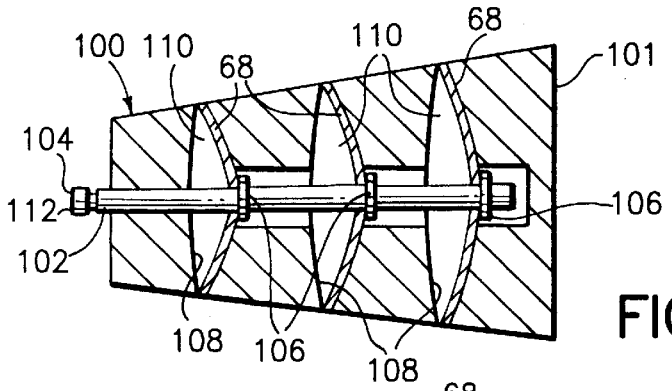
FIG. 4A is a cross-sectional view of an alternate embodiment of the wedge connector in a relaxed state.
Figure 4B:
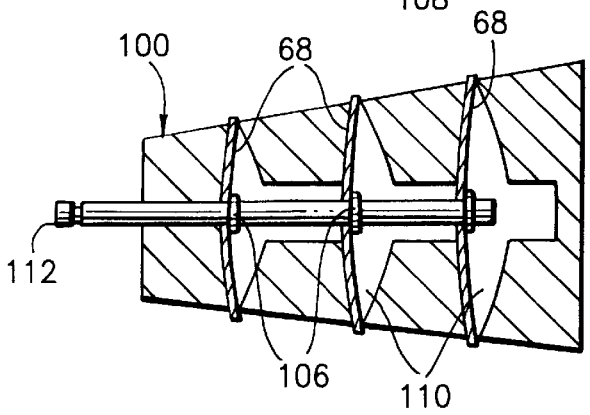
FIG. 4B is a cross-sectional view of the wedge shown in FIG. 4A in its deployed state.

Referring now to FIGS. 4A and 4B, an alternate embodiment of the wedge is shown in its relaxed state and its deployed state, respectively. The wedge 100 includes a frame 101 and an insulation piercing and conductor support section 102. The insulation piercing and conductor support section 102 includes the three leaves 68, a shaft 104, and three snap rings 106. The frame 101 is substantially the same as the frame 50 shown in FIG. 2A. However, the front wall 108 of the pockets 110 have a reverse camber to keep the leaves 68 locked in their deployed positions. The front end 112 of the shaft can be pulled by a tool to move the leaves 68 to their deployed position. In an alternate embodiment the shaft could be moved to its deployed position by pushing on the rear end of the shaft, such as by a blow from a hammer. With the invention as described above, the wedge is free to slide relative to the cables, without interference from the leaves, to its installed position in the shell. Only then is the insulation piercing and conductor support section deployed. This two stage approach requires less insertion force to insert the wedge into position in the receiving area in the shell.

Figure 5A:
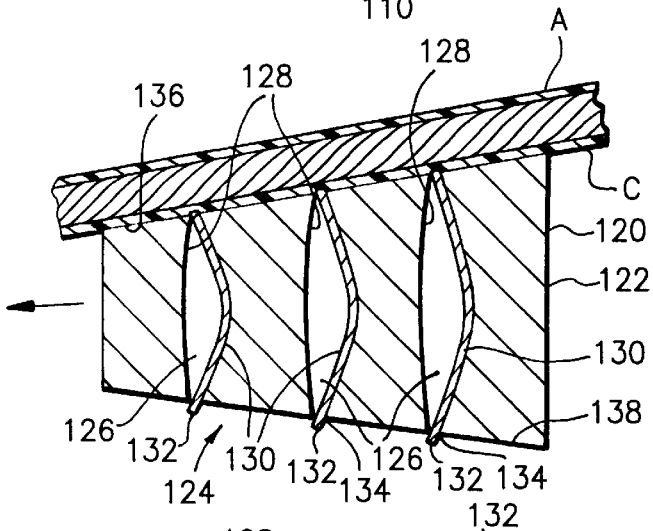
FIG. 5A is a cross-sectional view of another alternate embodiment of the wedge in a relaxed state and a cable located against the wedge.
Figure 5B:
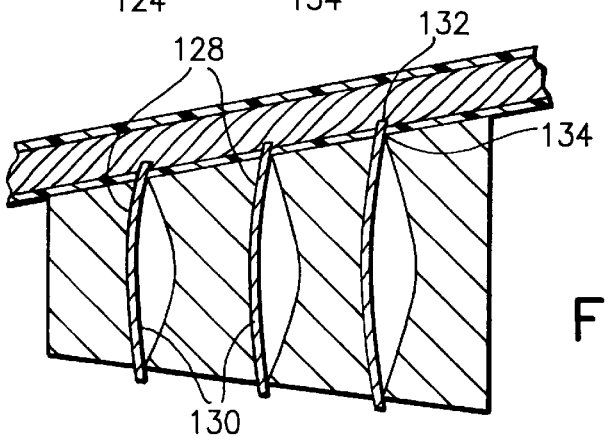
FIG. 5B is a cross-sectional view of the wedge shown in FIG. 5A in its deployed state.

Referring now to FIGS. 5A and 5B, another alternate embodiment of the wedge is shown in its relaxed state and its deployed state, respectively, relative to the cable A. The wedge 120 includes the frame 122 and the piercing/support section 124. The frame 122 has pockets 126 similar to those shown in FIGS. 4A and 4B with a front wall 128 having a reverse camber. However, there is no hole for a shaft to move the leaves. The piercing/support section 124 merely comprises the three leaves 130. No push or pull shaft is needed. Unlike the embodiments shown in FIGS. 2A, 2B and 4A, 4B, in the relaxed state the tips 132 of the leaves 130 extend out of the slots 134. Thus, when the wedge 120 is inserted into the wedge connector shell, the tips immediately contact the cables insulation C. As the cable contacting surfaces 136, 138 of the frame 122 slide across the insulation of the cable, the tips 132 dig into and penetrate through the insulation. The force of the relative movement between the wedge and the cable causes the leaves 130 to pop or snap against the front walls 128 of the pockets. The reverse camber locks the leaves in place. Thus, the insertion force from inserting the wedge toggles deployment of the piercing/support section. In alternate embodiments other types of automatic deployment systems could be used.

Figure 6:
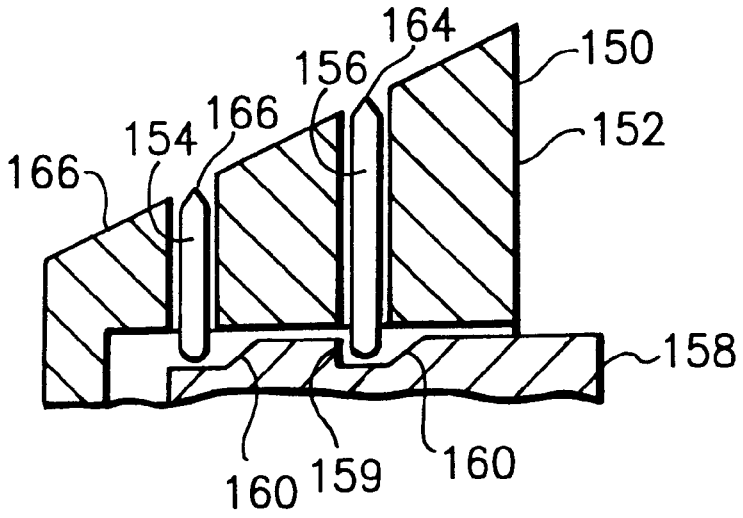
FIG. 6 is a partial cross-sectional view of another alternate embodiment of the wedge.
Figure 7:
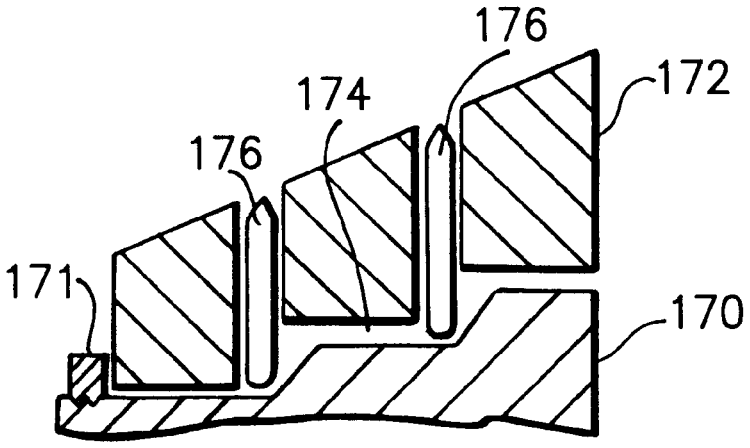
FIG. 7 is a partial cross-sectional view of another alternate embodiment of the wedge.

Referring now to FIG. 6, another alternate embodiment is shown. In this embodiment, the wedge 150 has a frame 152, support piercers 154, 156, and a cam member 158. When the wedge 150 is inserted into the shell, the cam member 158 is pushed forward. Cam surfaces 160 on the cam member 158 push the rear ends of the support piercers 154, 156 outward. The tips 162, 164 project past the frame's cable contact surface 166 to pierce through the cable's insulation and directly contact the conductor of the cable. FIG. 7 shows another alternate embodiment in which the cam member 170 has a stepped shape, the frame 172 has a step shaped cam receiving area 174, and the support piercers 176 have the same length and shape. The ledge 159 acts as a stop in the embodiment shown in FIG. 6 to prevent the cam member 158 from separating from the frame 152. Another latch could be used to lock the cam member in its forward position. In FIG. 7, the cam member 170 has a ring 171 attached to its front to prevent the cam member 170 from separating from the frame 172. In other alternate embodiments other cam configurations could be provided.

It should be understood that the foregoing description is only illustrative of the invention. Various alternative and modifications can be devices by those skilled in the art without departing from the invention. Accordingly, the present invention is intended to embrace all such alternative, modifications and variances which fall within the scope of the appended claims.

What is claimed is:

1. An electrical wedge connector comprising:

a shell having a first insulation piercing section adapted to pierce through insulation of an electrical cable and make electrical contact with an electrical conductor section of the cable; and a wedge which is sized and shaped to be inserted into the shell to sandwich the cable between the wedge and the shell, the wedge having a second insulation piercing section to pierce through the insulation of the cable to directly contact the electrical conductor section of the cable, wherein the wedge comprises a frame, the second insulation piercing section is received in the frame and extends out of the frame, and the electrical conductor section is directly contacted by both the shell and the wedge.

2. A connector as in claim 1 wherein the second insulation piercing section is movably attached to the frame.

3. A connector as in claim 2 wherein the frame has a cable contact surface for directly contacting the cable to sandwich the cable directly between the frame and the shell.

4. A connector as in claim 3 wherein the second insulation piercing section comprises a locking spring member located in the frame and deflectable between a relaxed position and a deployed position, wherein in the deployed position an insulation piercing tip of the locking spring member extends outward past the cable contact surface of the frame.

5. A connector as in claim 4 wherein the locking spring member has two insulation piercing tips that extend from two of the cable contact surfaces on opposite sides of the frame.

6. A connector as in claim 4 wherein the second insulation piercing section includes a shaft for moving an interior portion of the locking spring member forward on the frame.

7. A connector as in claim 6 wherein the shaft comprises a bolt on the frame and a nut is attached to the bolt directly adjacent the interior portion of the locking spring member, wherein the bolt can be rotated to move the nut and thereby move the interior portion.

8. A connector as in claim 6 wherein the shaft is a pull pin longitudinally movable along a center axis of the frame.

9. A connector as in claim 4 wherein the tip extends outward past the cable contact surface of the frame in the relaxed position, and automatically moves to the deployed position when the connector is attached to cable by surface contact of the cable on the tip.

10. A connector as in claim 3 wherein the second insulation piercing section comprises a cam movably mounted to the frame and a laterally extending insulation piercer movably mounted to the frame to be pushed by the cam to extend a tip of the piercer past the cable contact surface of the frame.

11. In a wedge for an electrical wedge connector, the wedge comprising a frame with cable contact surfaces for compressing electrical conductor cables against a wedge connector shell, wherein the improvement comprises:

conductor supports movably mounted to the frame that pierce through insulation of the cables to directly contact electrical conductors of the cables inside the insulation.

12. A wedge as in claim 11 wherein the frame has slots through the cable contact surfaces which the conductor supports are located.

13. A wedge as in claim 12 wherein the conductor supports each comprise a spring steel leaf with opposite end tips that extend outward past the cable contact surfaces of the frame to pierce through the insulation.

14. A wedge as in claim 13 further comprising a movement member connecting a middle section of the leaves to the frame to move the middle sections along a longitudinal axis of the frame.

15. A wedge as in claim 11 further comprising means for automatically moving the conductor supports when the wedge is attached to the cables with the shell.

16. A wedge as in claim 11 wherein tips of the conductor supports extend outward past a cable contact surface of the frame in a relaxed position, and automatically move to a deployed position when the wedge is attached to cable by surface contact of the cable on the tips.

17. A wedge as in claim 11 further comprising a cam movably mounted to the frame and the conductor supports comprise laterally extending insulation piercers movably mounted to the frame to be pushed by the cam to extend tips of the piercers past cable contact surfaces of the frame.

18. An electrical wedge connector comprising:

a shell having a first insulation piercing section adapted to pierce through insulation of an electrical cable and make electrical contact with an electrical conductor section of the cable; and a wedge which is sized and shaped to be inserted into the shell to sandwich the cable between the wedge and the shell, the wedge having a frame and a second insulation piercing section movable on the frame to pierce through the insulation of the cable to directly contact the electrical conductor section of the cable, wherein the frame has a cable contact surface for directly contacting the cable to sandwich the cable directly between the frame and the shell, and the electrical conductor section is directly contacted by both the shell and the wedge.

* * * * *